US009833677B2

(12) United States Patent
Ross

(10) Patent No.: US 9,833,677 B2
(45) Date of Patent: Dec. 5, 2017

(54) SWING TRAINING HARNESS AND ASSOCIATED KIT COMBINATION INCORPORATING ELASTIC STRETCH BANDS CONNECTING VIA SLIDING RINGS TO A HANDLE LOCATION OR TO KNOB END EXTENDING ATTACHMENT OF A BAT

(71) Applicant: Glenn Ross, Lincoln Park, MI (US)

(72) Inventor: Glenn Ross, Lincoln Park, MI (US)

( * ) Notice: Subject to any disclaimer, the term of this patent is extended or adjusted under 35 U.S.C. 154(b) by 0 days.

(21) Appl. No.: 15/450,068

(22) Filed: Mar. 6, 2017

(65) Prior Publication Data

US 2017/0252621 A1 Sep. 7, 2017

Related U.S. Application Data

(60) Provisional application No. 62/303,728, filed on Mar. 4, 2016.

(51) Int. Cl.
*A63B 69/36* (2006.01)
*A63B 69/00* (2006.01)

(52) U.S. Cl.
CPC ..... *A63B 69/0002* (2013.01); *A63B 69/0059* (2013.01); *A63B 2069/0008* (2013.01); *A63B 2208/0204* (2013.01)

(58) Field of Classification Search
USPC ..... 473/207, 212–216, 226, 227, 266, 277, 473/458
See application file for complete search history.

(56) References Cited

U.S. PATENT DOCUMENTS 2,103,502 A * 12/1937 Webster ..... A63B 69/3608 473/215
3,429,571 A 2/1969 Abel
5,362,295 A * 11/1994 Nurge ..... A63B 21/00061 482/121
5,640,719 A 6/1997 Ritchie
5,993,362 A * 11/1999 Ghobadi ..... A63B 21/0004 482/121
6,270,430 B1 * 8/2001 Nicoloff ..... A63B 69/0026 473/207

(Continued)

FOREIGN PATENT DOCUMENTS

WO 2005009544 A3 1/2007

*Primary Examiner* — Nini Legesse
(74) *Attorney, Agent, or Firm* — Dinsmore & Shohl LLP

(57) ABSTRACT

A batter swing training harness and associated kit including a belt adapted to being affixed about a wearer's waist, a vertical portion extending downwardly from the belt and terminating in a looped portion adapted to being affixed about the wearer's upper leg and a first pair elastic bands extending from vertically spaced locations of the belt and vertical portion. A second individual elastic band extends from a further location of the belt. Each of the first pair of bands and the second individual band terminate in a ring adapted to being slidably supported upon a stem extending from a knob end of a bat. The harness controls a motion of the bat during each of a backswing and forward follow through to correct flaws in the batters swing, such resulting in the rings detaching either prematurely from the stem prior to completion of the swing to instruct incorrect positioning of the bat, or detaching from the stem during the forward follow through of a correct swing in order to allow the user to complete the swing.

6 Claims, 15 Drawing Sheets

(56) References Cited

U.S. PATENT DOCUMENTS

| | | | | |
|---|---|---|---|---|
| 6,375,581 | B1 | 4/2002 | Urban et al. | |
| 6,832,960 | B2 * | 12/2004 | Thony | A63B 69/0059 473/207 |
| 7,128,658 | B2 | 10/2006 | DuFour | |
| 7,314,437 | B2 * | 1/2008 | Frappier | A63B 21/00065 482/124 |
| 7,625,320 | B2 | 12/2009 | Wehrell | |
| 7,632,192 | B2 * | 12/2009 | Begert | A63B 21/0004 473/215 |
| 8,512,171 | B1 | 8/2013 | Minotti | |
| 8,550,930 | B1 | 10/2013 | Medin, III | |
| 9,561,421 | B2 | 2/2017 | Hungelmann | |
| 2007/0232404 | A1 | 10/2007 | Begert | |
| 2011/0165955 | A1 * | 7/2011 | Moore | A63B 69/0059 473/215 |
| 2011/0212797 | A1 | 9/2011 | Adkins | |
| 2015/0165293 | A1 | 6/2015 | Hamilton et al. | |

* cited by examiner

SWING TRAINING HARNESS AND ASSOCIATED KIT COMBINATION INCORPORATING ELASTIC STRETCH BANDS CONNECTING VIA SLIDING RINGS TO A HANDLE LOCATION OR TO KNOB END EXTENDING ATTACHMENT OF A BAT

CROSS-REFERENCE TO RELATED APPLICATIONS

This application claims the benefit of U.S. Provisional Application 62/303,728 filed on Mar. 4, 2016, the contents of which is incorporated herein in its entirety.

FIELD OF THE INVENTION

The present invention relates generally to training harness for a batter. More specifically, the present invention discloses a wearable harness with multiple attachment locations and which includes heavy duty and elastic bands which attach to a knob end of a baseball handle for the purpose of training and correcting improper batter swing form by providing restriction to swinging motion outside of a desirable arc or trajectory.

BACKGROUND OF THE INVENTION

The prior art is documented with examples of swing training devices, a first example of this being shown in US 2007/0232404 to Begert which teaches a multi-sport training apparatus for teaching and improving hitting and throwing skills. Features include an adjustable waist belt with a buckle and a resilient connector having a distal end and a proximal end. Two clamps are disposed on the waist belt such that when the waist belt is worn at least one clamp is located near the iliac crest of the user's leading hip and may be employed for adjustably capturing and retaining the proximal end of the resilient connector. A swivelable clip is disposed on the distal end of said resilient connector, a sports implement/hand connector having a hook for attachment to the clip.

U.S. Pat. No. 6,375,581, to Urban et al., teaches an instructional swing device for teaching the proper swing for baseball, golf or the like. The instructional swing device includes a vest or harness arrangement which positions an adjustable, stretchable strap across the torso of the user from one shoulder to the opposite hip. Attached to the strap is an audible indicating mechanism, such as a buzzer, which is activated by proper movement of the user through stretching of the strap. In operation, the audible indicating mechanism identifies a proper swing during use to provide feedback to the user that the user is performing the desired hip movement in advance of the hands.

U.S. Pat. No. 8,512,171, to Minotti, teaches a batter training apparatus and method for training batters to attain optimal biomechanics for most effectively hitting a ball, with a proper rotation of a batter's hips and proper follow through with a batter's arms, wrists and shoulders. The training apparatus includes a belt worn over the hips that has a cable extending behind and between the hips. A tether connects the belt to a support post, preventing forward motion of the batter's body, but allowing and conditioning the hips to rotate. The support post sits at the rear of a platform that is about the size of a batter's box. An elastic cord connected to a forward arm and attached to the front of the platform, pulls a batter's wrists, arms and shoulders forward during proper follow through, conditioning the batter to swing the bat efficiently.

Also of note is the relative hip motion athletic training device and method of Medin, III, U.S. Pat. No. 8,550,930, and which teaches a sport training device wearable by a human user, including an oblong resilient, flexible member diagonally connecting one side of a shoulder harness to the opposite side of a separate hip harness. The member is tensioned in the user's upright, untwisted standing position. During a swing or a baseball-type pitching action, as the user's hips properly rotate with respect to the user's shoulders, the tension reduces thus encouraging and indicating to the user the preferred relative hip rotation action. Adjustments are provided adjust the length and tension of the resilient member. A member which deflects uniformly under a compressive load can be used as a measuring device of the relative angle between the hip and shoulder.

SUMMARY OF THE INVENTION

The present invention discloses a batter swing training harness and associated kit including a belt adapted to being affixed about a wearer's waist, a vertical portion extending downwardly from the belt and terminating in a looped portion adapted to being affixed about the wearer's upper leg and a first pair elastic bands extending from vertically spaced locations of the belt and vertical portion. A second individual elastic band extends from a further location of the belt.

Each of the first pair of bands and the second individual band terminate in a ring, these being slidably supported upon a stem extending from a knob end of a bat. The harness controls a motion of the bat during each of a backswing and forward follow through to correct flaws in the batters swing, such resulting in the rings detaching either prematurely from the stem prior to completion of the swing to instruct incorrect positioning of the bat. The rings alternately detach from the stem during the forward follow through of a correct swing in order to allow the user to complete the swing.

Additional features include an upper of the first pair of elastic bands teaching hip rotation during the swing, a lower of said first pair of elastic bands teaching foot drive and rotation during the swing. The second forward elastic band teaches each of hand speed and bat speed during the swing. A fixed buckle portion is provided at a first end of the belt, an adjustable buckle portion at a second end. Other features include a pair of flexible and stretch limiting fabric portions associated with opposite connecting ends of the first pair of elastic bands and which define a maximum degree of stretch of the bands.

An associated kit for instructing a batter swing likewise includes a training harness including a belt adapted to being affixed about a wearer's waist, and with a vertical portion extending downwardly from the belt and terminating in a looped portion adapted to being affixed about the wearer's upper leg. The first pair elastic bands extend from vertically spaced locations of the belt and vertical portion along with the second individual elastic band extending from a further location of the belt.

Again, each of the first pair of bands and the second individual band terminate in a ring. An attachment is provided for use with a bat, the attachment includes a base mounting portion adapted to being affixed to a knob end of the bat, with a stem extending from the base mounting portion along a centerline defined by a linear axis passing through a center of the longest axis of the bat. The rings are adapted to being attached to the stem.

The harness controls a motion of the bat during each of a backswing and forward follow through to correct flaws in the batters swing, the rings detaching either prematurely from the stem prior to completion of the swing to instruct incorrect positioning of the bat or detaching from the stem during the forward follow through of a correct swing in order to allow the user to complete the swing.

The associated kit as constructed accordingly instructs an upper of the first pair of elastic bands teaching hip rotation during the swing, with a lower of the first pair of elastic bands teaching foot drive and rotation during the swing. Concurrently, the second forward elastic band teach each of hand speed and bat speed during the swing. The base mounting portion of the knob end attachment further includes a closed perimeter profile accessing an open interior and for resistively seating therein the knob.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
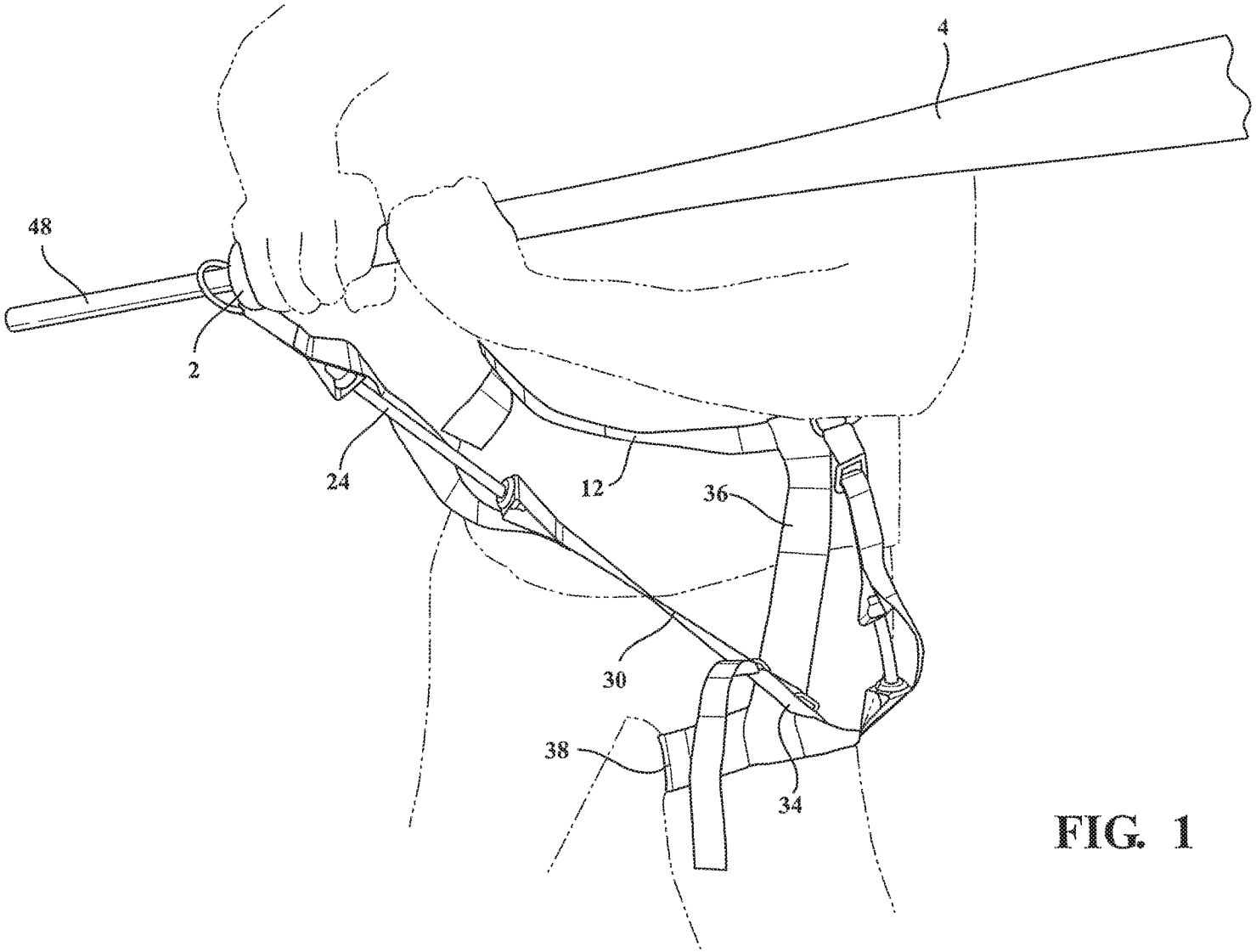
FIG. 1 is a first environmental perspective illustration of the batter swing training harness according to one non-limiting embodiment of the present inventions.
Figure 2:
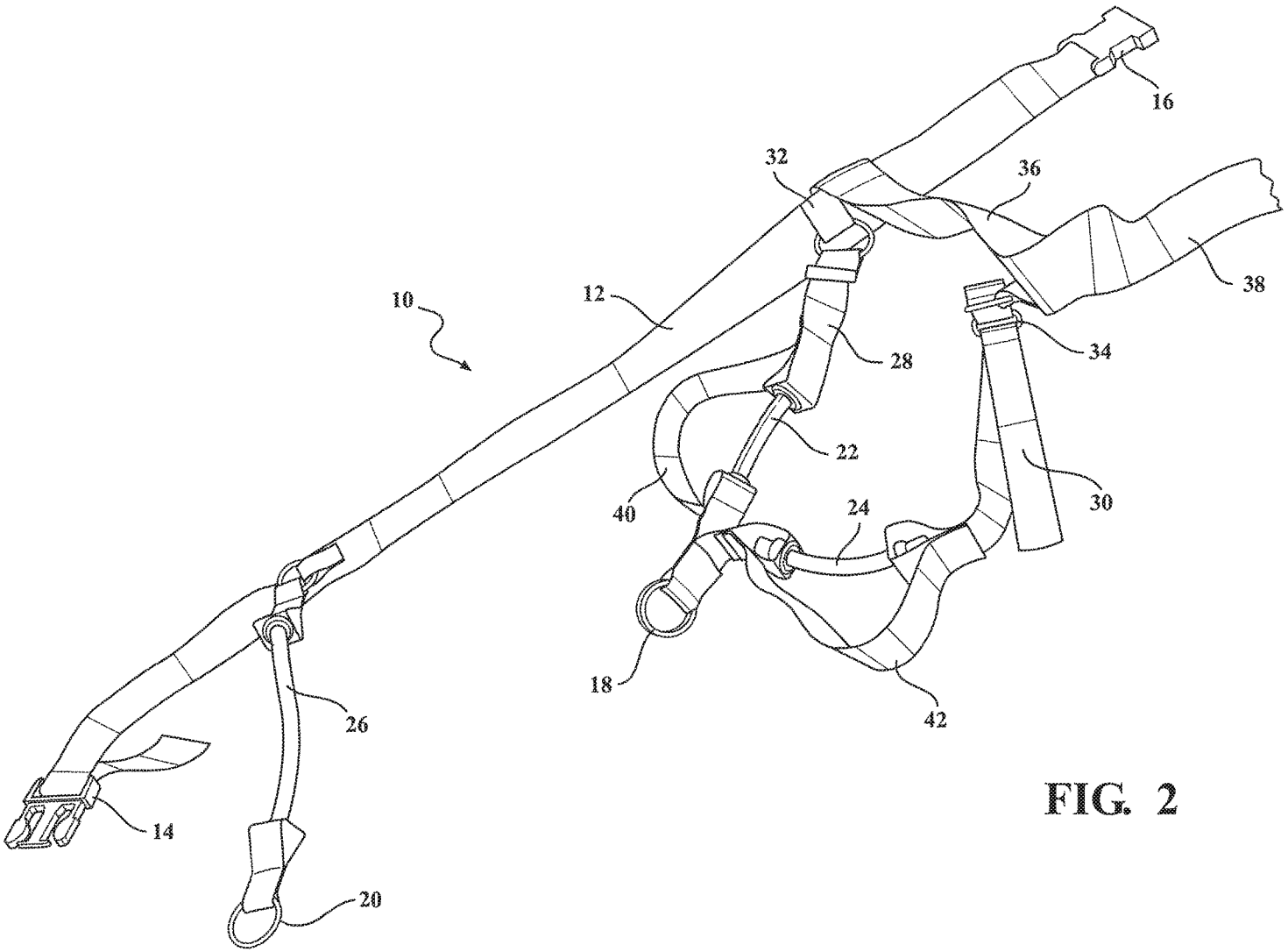
FIGS. 2-4 are a succession of views showing the harness laid flat upon a supporting surface and better showing one variant in which the connection locations include sliding rings incorporated into extending ends of the elastic bands, such adapted to being connected to a variant of bat exhibiting a tapered and non-knob end bat handle and to facilitate slide-off disengagement of the rings in the instance of improper swing form exhibited by the batter.
Figure 3:
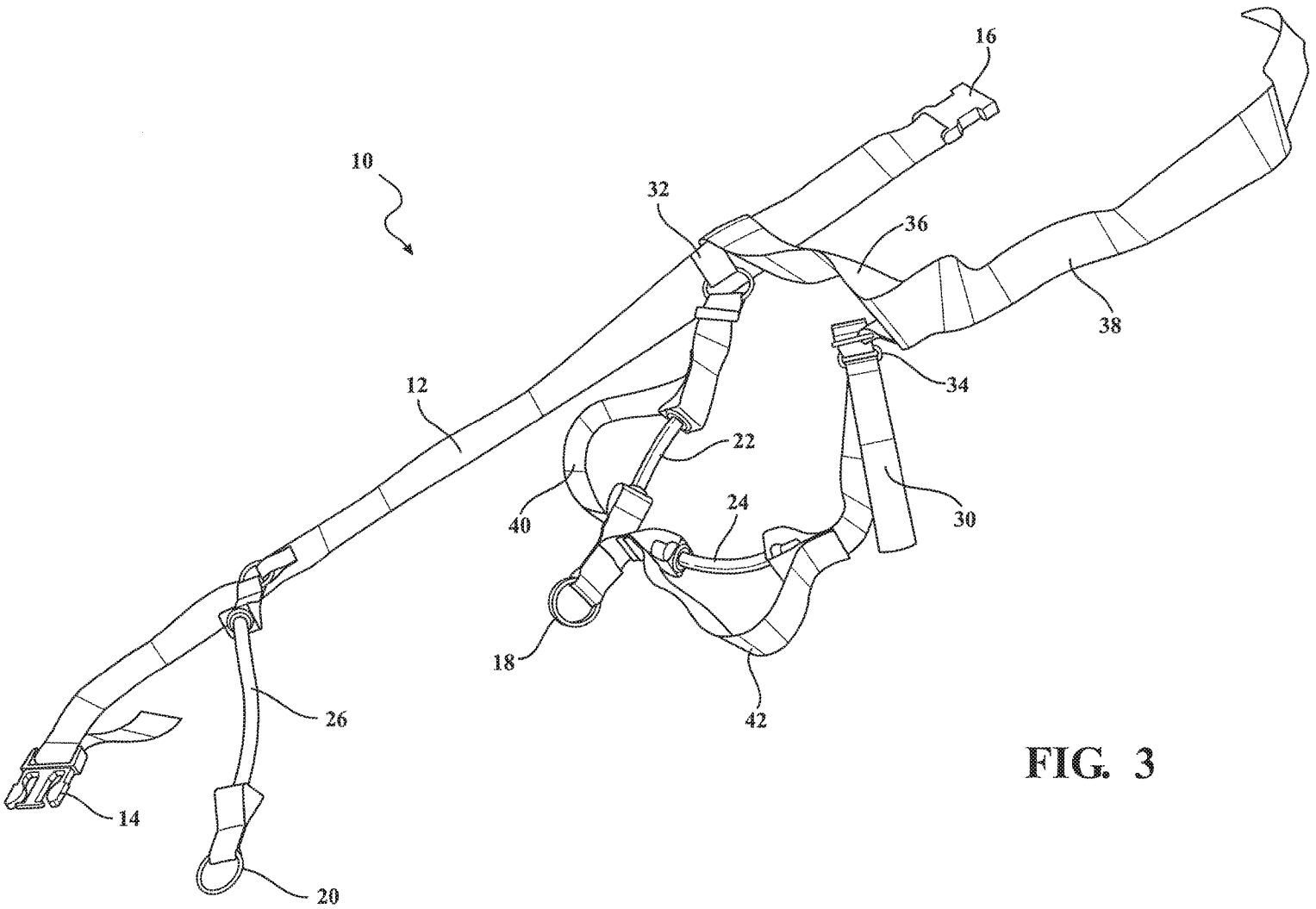
Figure 4:
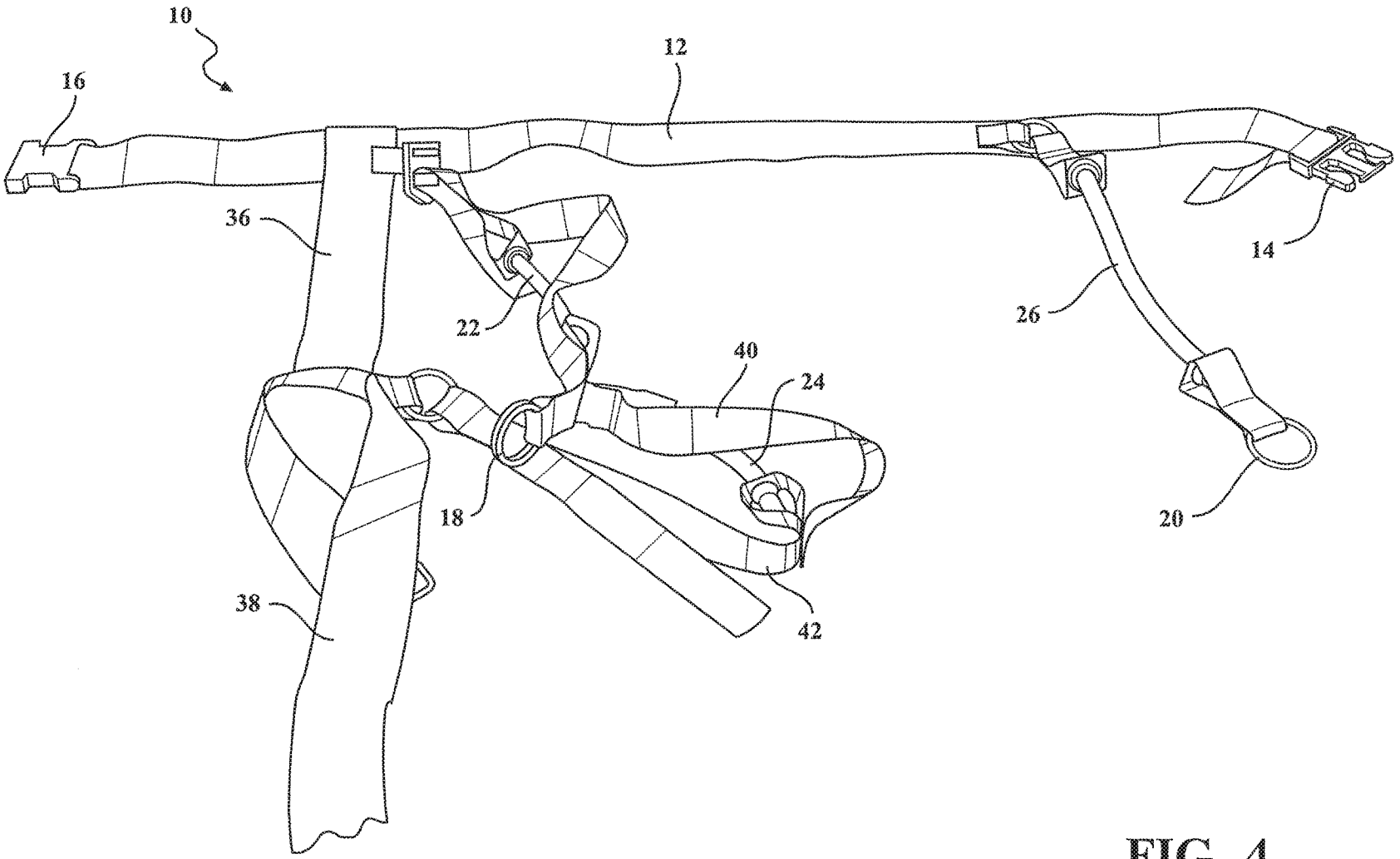
Figure 5:
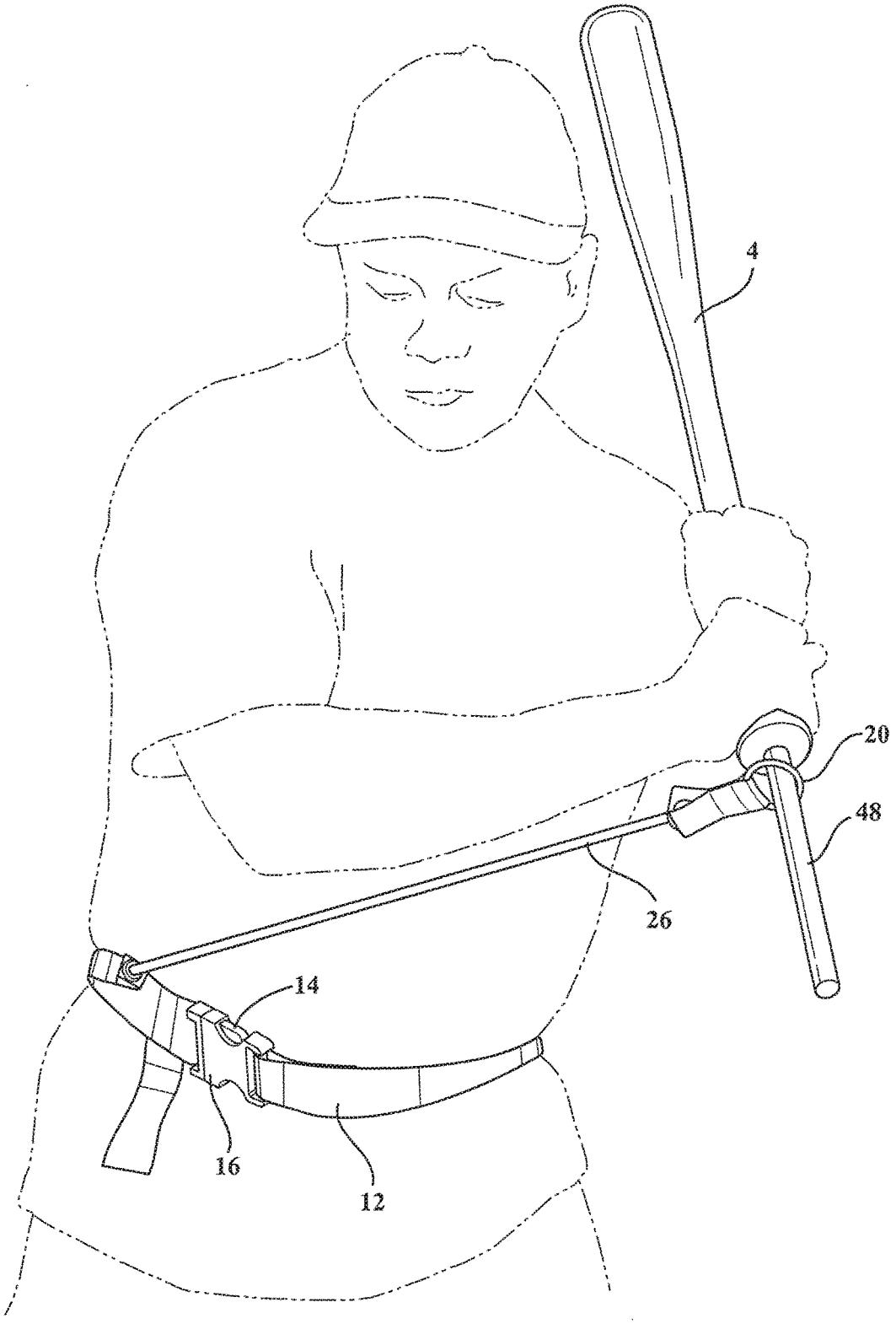
FIGS. 5-11 exhibit a succession of views of the swing training harness strapped to a user and which includes, according to an exemplary and non-limiting embodiment, a first pair of (example shown left leg and hip) connection locations extending from a pair of vertically spaced locations, these including elastic bands terminating in a first bat handle sliding ring and, in combination with a second (right side waist) single elastic connection location terminating in a second bat handle sliding ring, properly guides and trains complete backswing, swing through, bat speed and associated hand speed and positioning via the length and stretch resistance incorporated into the elastic bands, the configuration of the harness being such that the handle supported sliding rings will detach if the bat is swung in an incorrect orientation.
Figure 6:
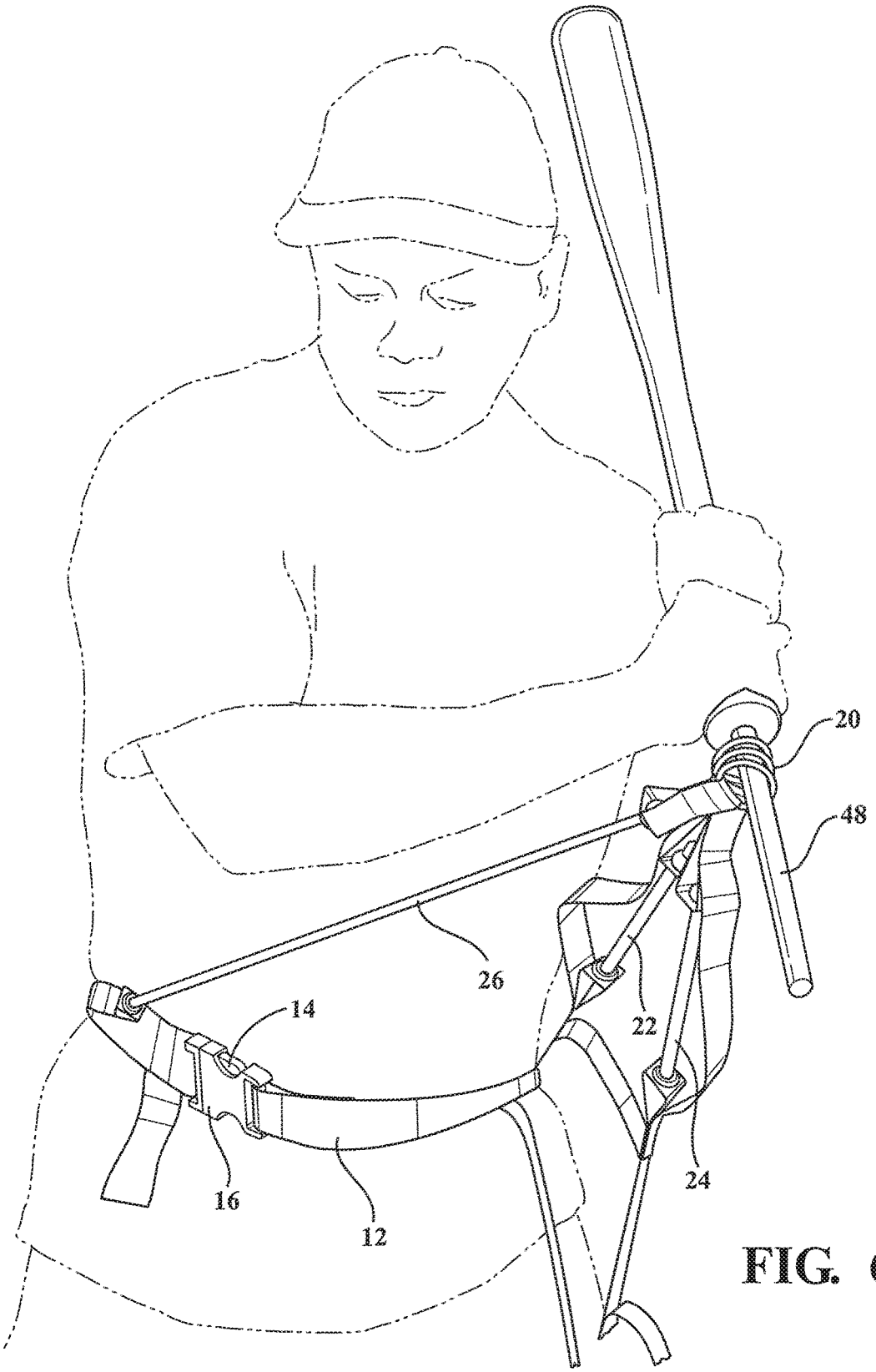
Figure 7:
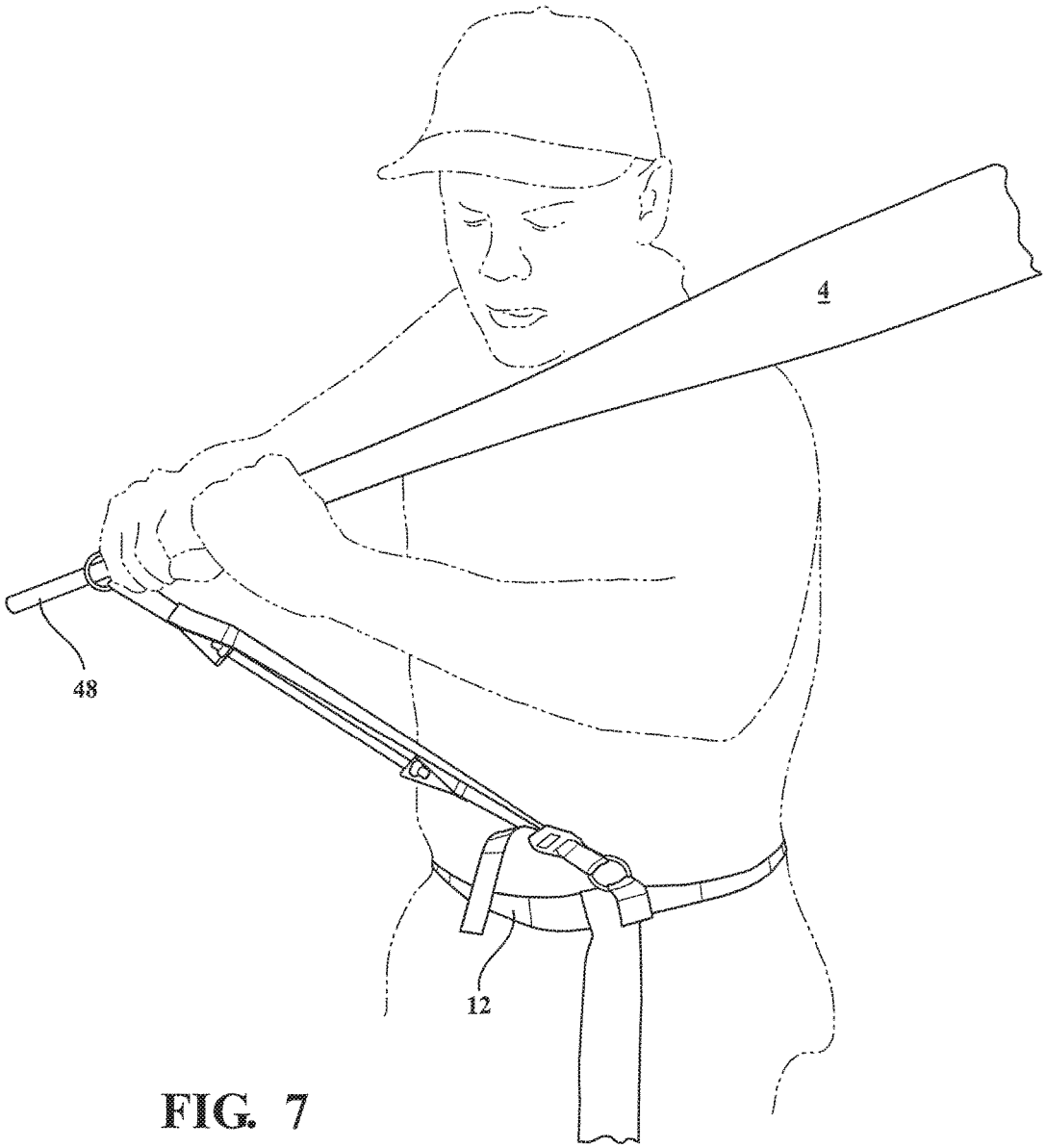
Figure 8:
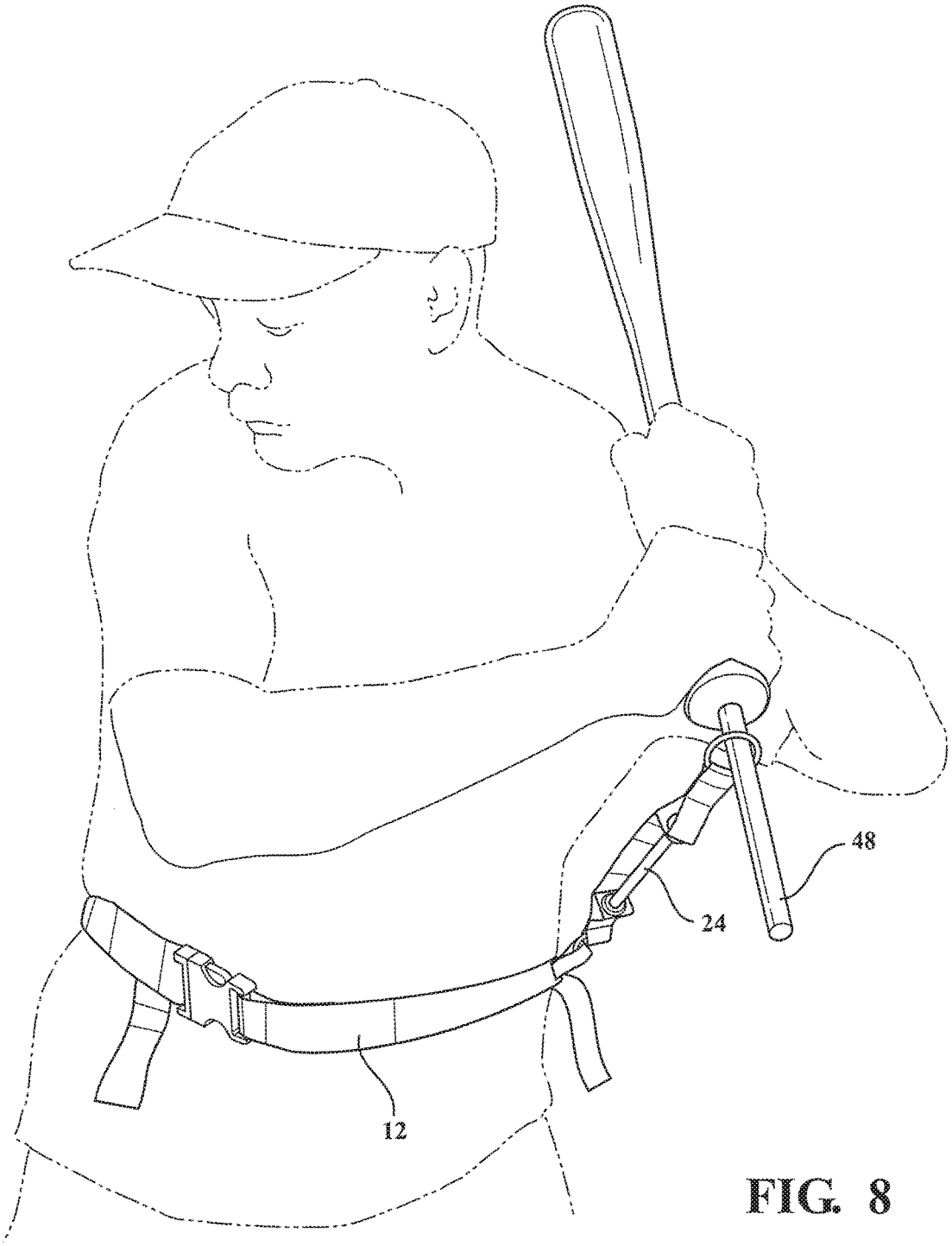
Figure 9:
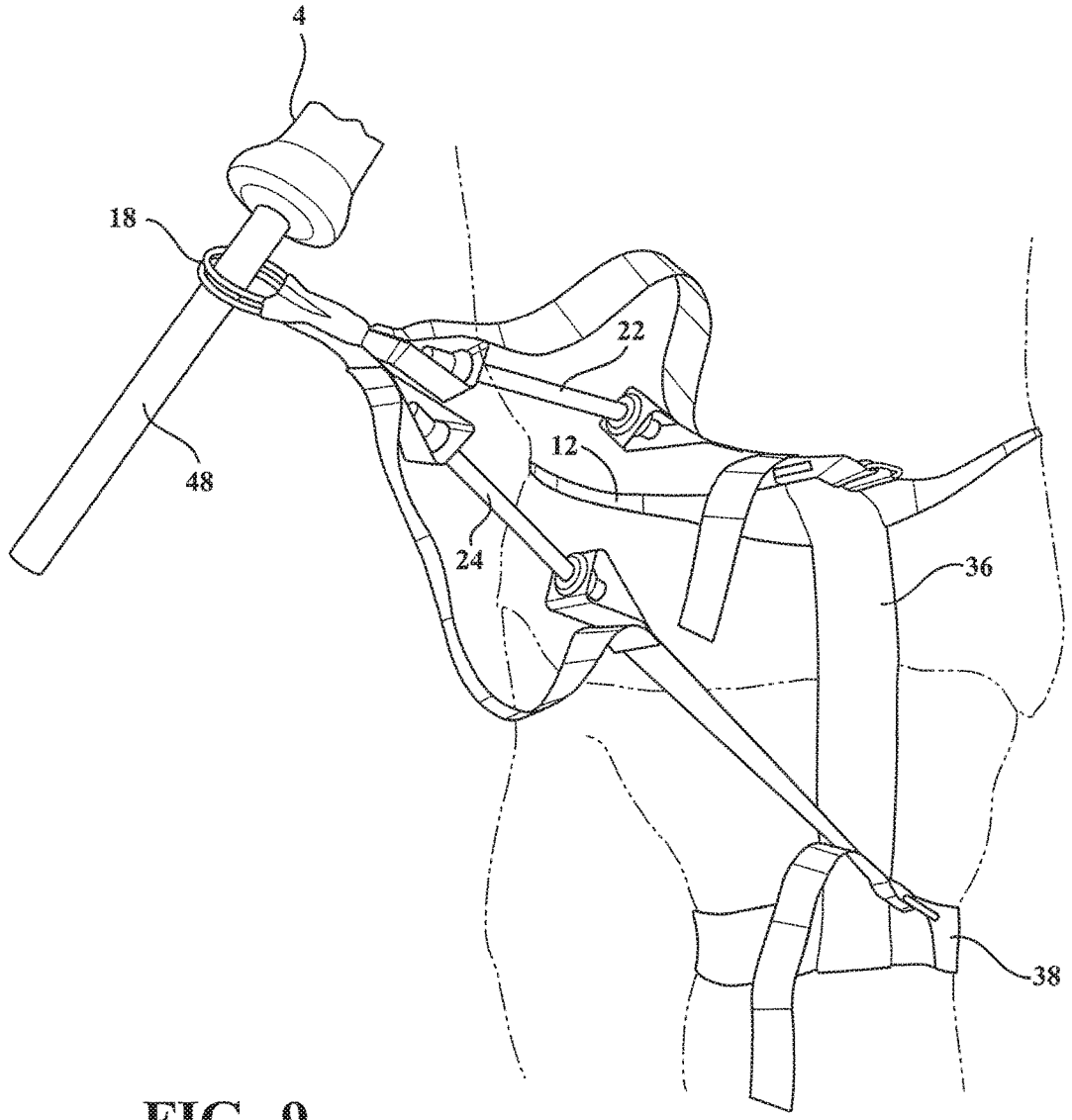
Figure 10:
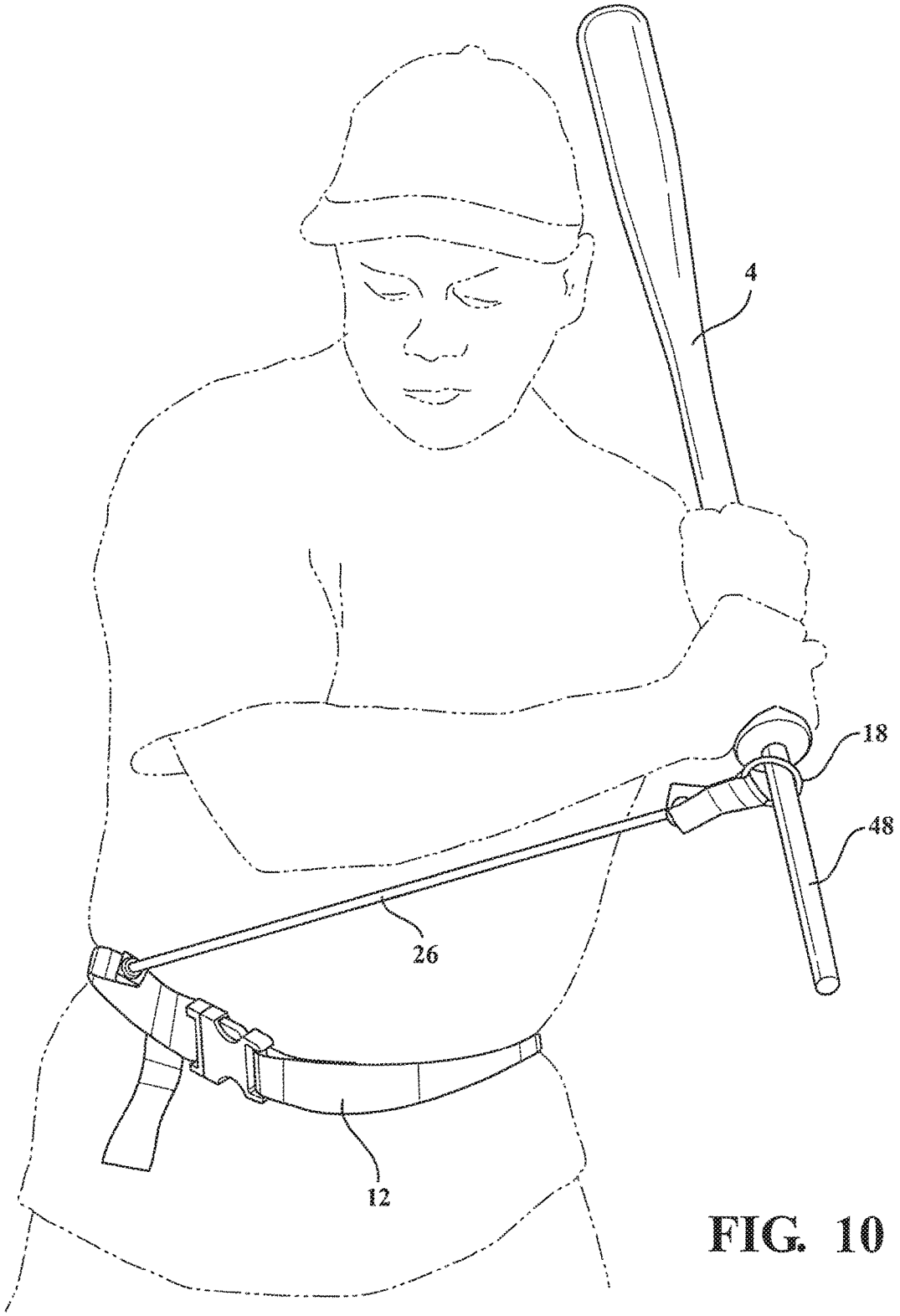
Figure 11:
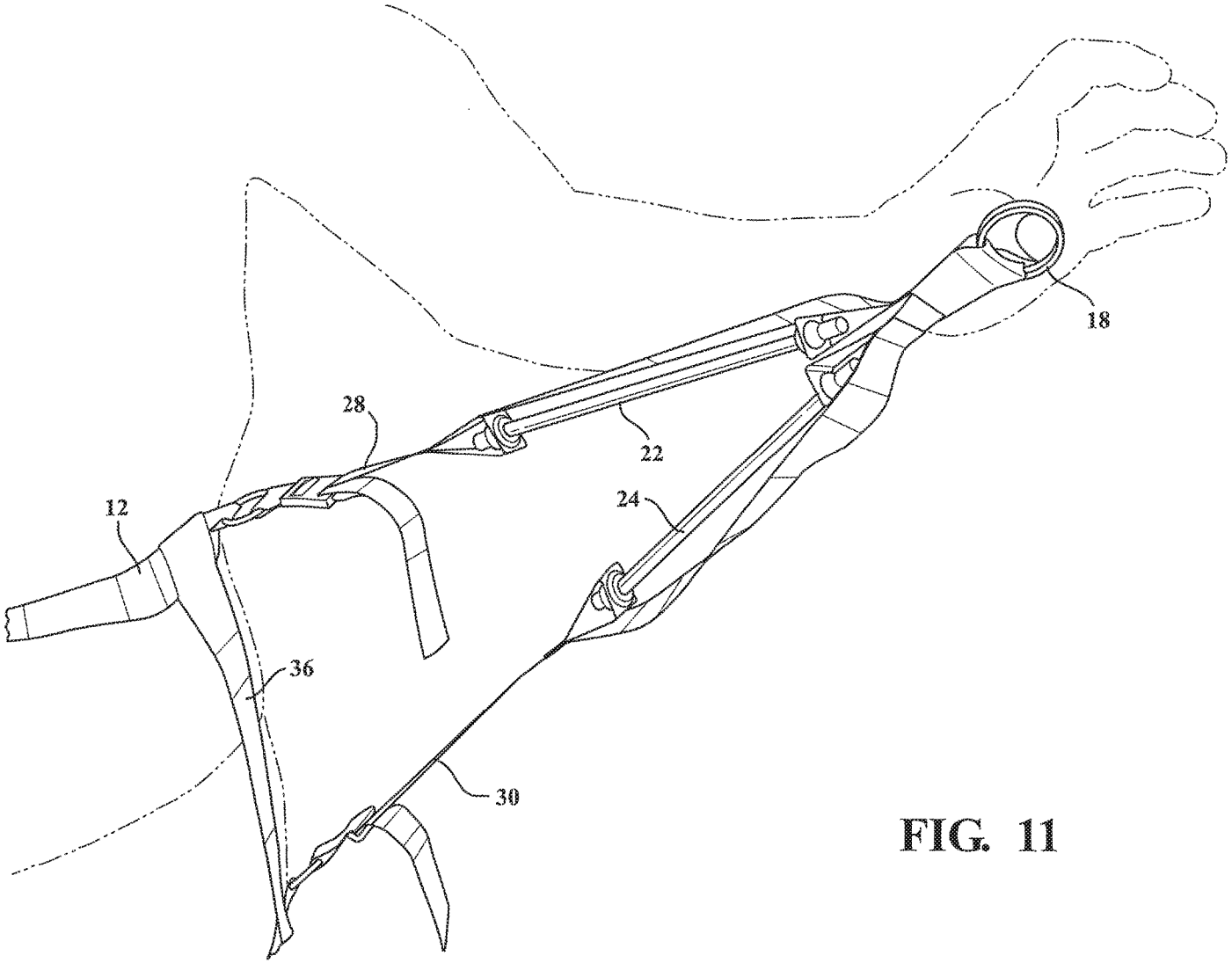

Referring now to the attached illustrations, the present invention discloses a wearable harness, generally at 10 in each of FIGS. 2-4, with multiple attachment locations and which includes heavy duty and elastic bands which attach to a knob end of a baseball handle for the purpose of training and correcting improper batter swing form by providing restriction to swinging motion outside of a desirable arc or trajectory. As will be described in additional detail, the training harness typically provides a waist-wearable attachment and which can be provided in kit or assembly combination with a variety of bat knob end attachments (see FIGS. 1, 5-10, 12, 13 and 15-17).

FIG. 1 is a first environmental perspective illustration of the batter swing training harness according to one non-limiting embodiment of the present inventions, with FIGS. 2-4 providing a succession of views showing the harness 10 laid flat upon a supporting surface. In one non-limiting variant, the harness includes a wait attachment belt or loop 12, such including a first length adjustable clasp or buckle portion 14 along with a second end extending clasp or buckle portion 16. The connection locations include sliding rings, see at 18 and 20, which are incorporated into extending ends of a plurality of elastic bands, and which include a first pair of such bands 22 and 24 incorporated into a first section of the wait belt 12 and a further band 26 incorporated into a second section of the belt.

As further shown in the succession of views in FIGS. 5-11, the first pair 22 and 24 of elastic bands can extend from flexible but non-elastic portions 28 and 30, the non-elastic portion 28 being in turn connected to a belt 32 location and the further non-elastic portion 30 being connected to a lower end location 34 of a vertical extension 36, the extension being in turn supported by a bottom most looped end 38 which is mounted to the wearers upper selected (left in this instance) leg, also termed as upper and lower rear locations. Additional non-elastic flex straps, see at 40 and 42 as best shown in FIG. 2, provide for a maximum defined range or degree of extension of the elastic bands 22 and 24 associated with the first pair of connection points.

Figure 13A:
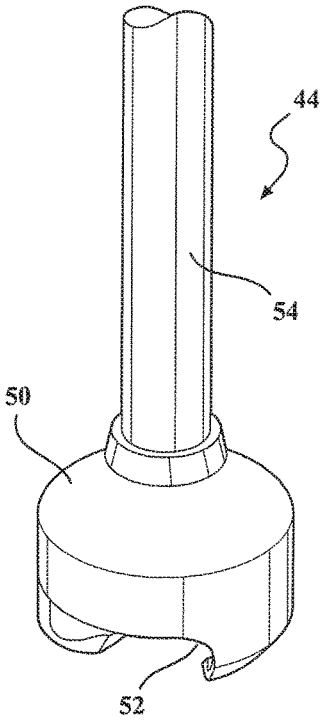
FIGS. 13A-13B illustrate a pair of alternate bat knob end attachment portions for providing a small diameter tubular extension for receiving the harness elastic band rings.
Figure 13B:
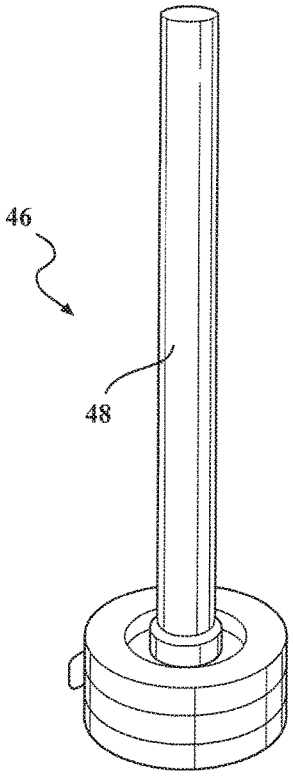
Figure 14:
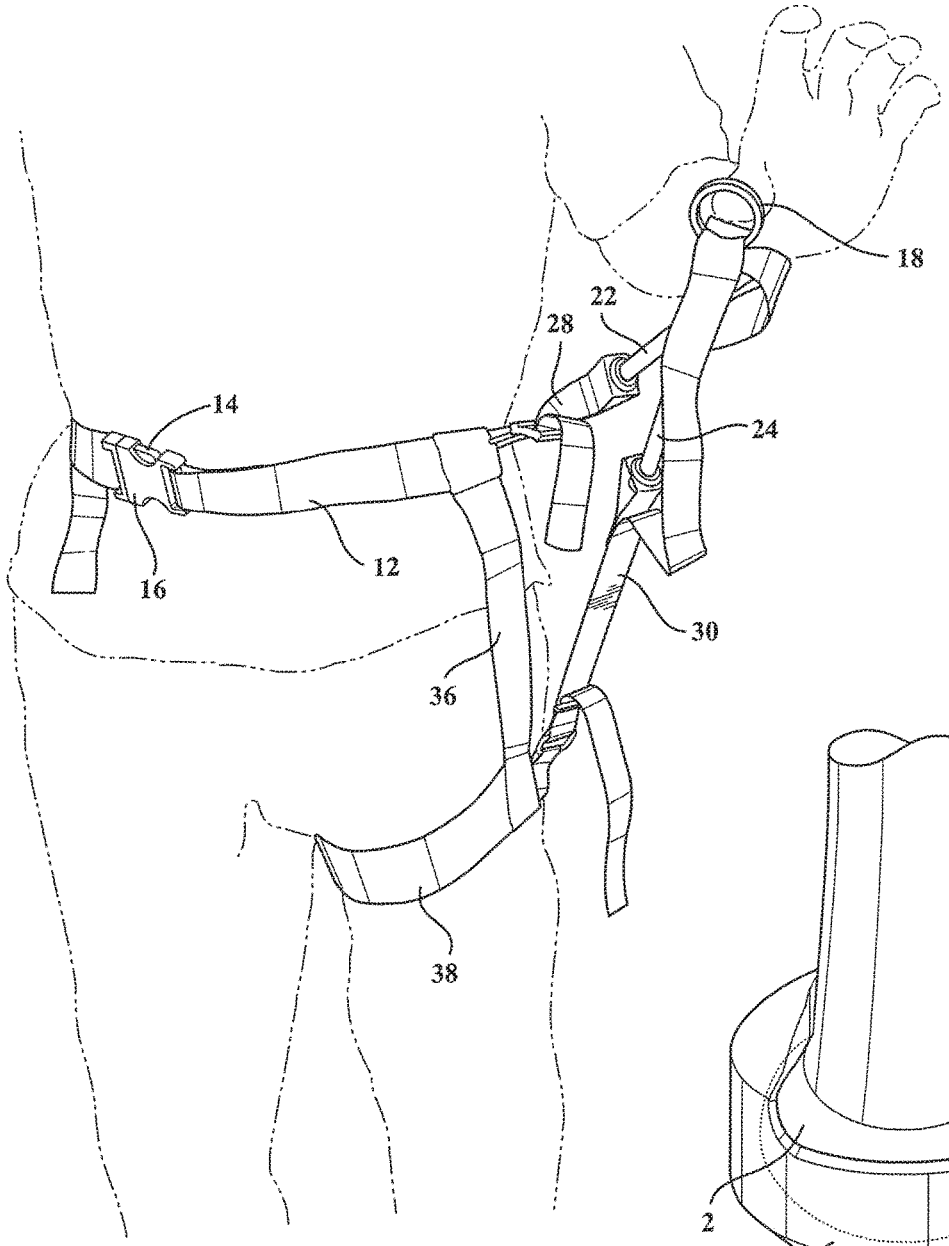
FIG. 14 is a rotated view of the left side two point connection of the harness shown in FIG. 11 disengaged from the bat.
Figure 15:
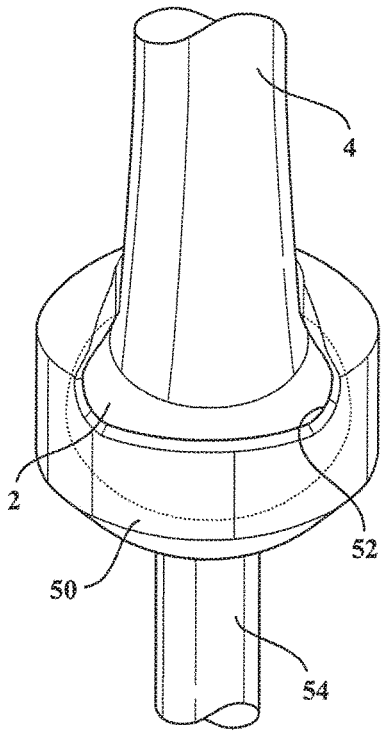
FIG. 15-17 are a succession of views of a further variety of bat knob end connections for providing a handle projecting stem for receiving the elastic band rings.
Figure 16:
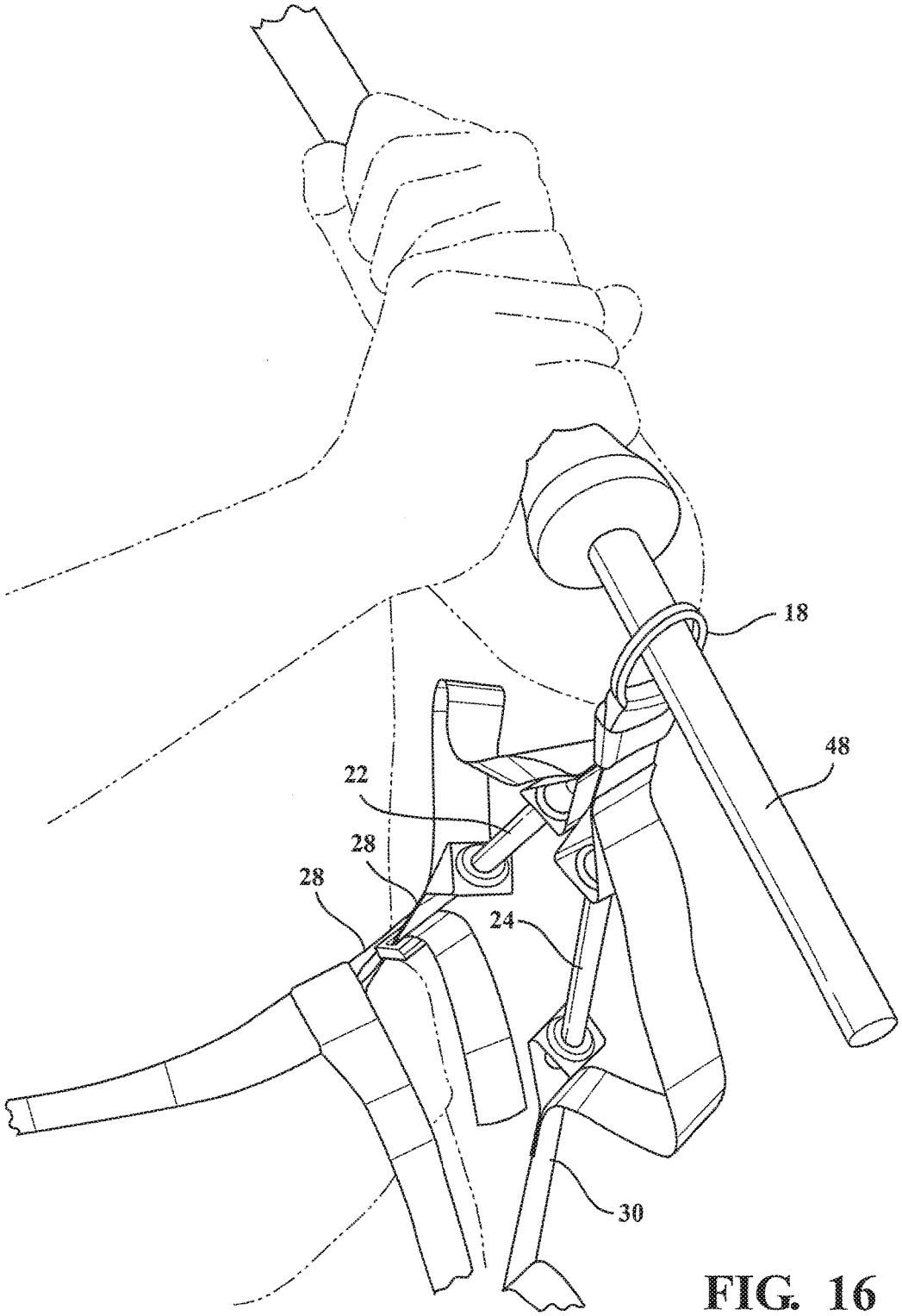
Figure 17:
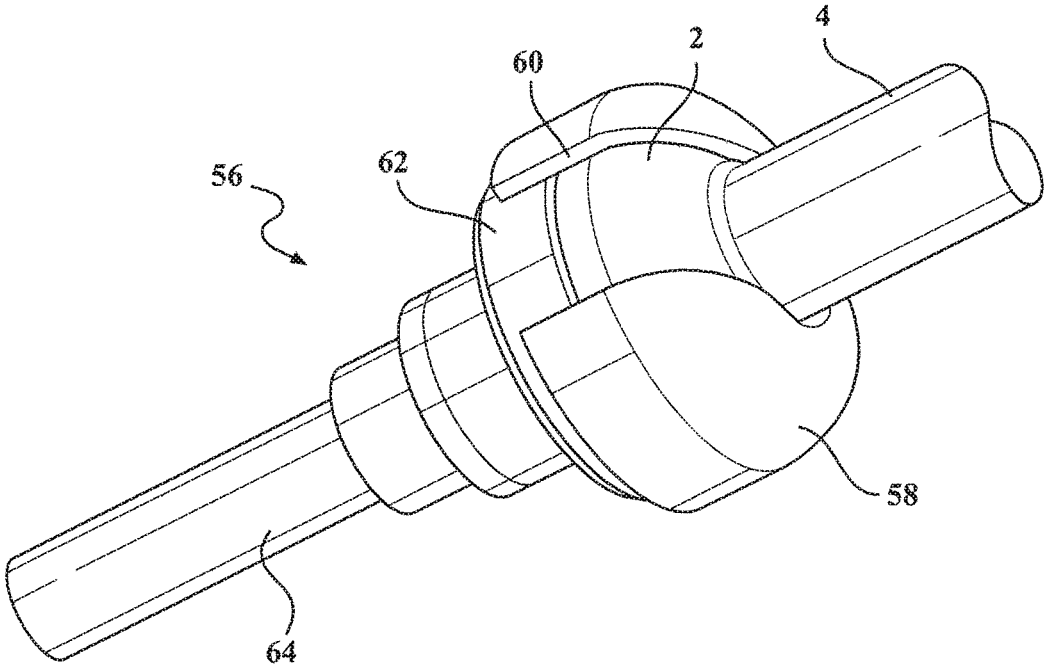

As further shown in FIGS. 5-11, the second (right side waist) single elastic connection 26 terminating in the second bat handle sliding ring 20 (also termed a forward location given the overall orientation of the batter) is located at a position along the waist belt 12 generally opposite that of the first pair of connection locations (bands 22/24 which terminate in rings 18. As further shown, a bat handle knob end attach, see variants 44 and 46 respectively in FIGS. 13A and 13B, are attached to the knob end 2 (see in FIG. 1 et. seq) of a bat 4, and so that an elongated stem portion 48 of the selected attachment 46 secured to the bat 4 is provided in linear extending fashion along a linear centerline of the bat for a predetermined distance beyond the knob end.

Accordingly, and upon the belt being attached about the wearer's waist and the vertical extension 36 with the looped lower end 38 attached to the selected (left) upper leg and, the rings 18 and 20 (right side extension 26) are guided onto the extending stem 48 of the knob end attachment. In use, the harness properly guides and trains the user in each of a complete backswing, swing through, bat speed and associated hand speed and positioning, this via the selected length and stretch resistance incorporated into the elastic bands. The configuration of the harness 10 is further such that the handle supported sliding rings 18 and 20 will detach if the bat 4 is swung in an incorrect orientation, prior to completion of the swing, this instructing inaccurate motion or positioning of the bat or hands. The design of the harness is further such that the rings may nominally disengage (slide off) the stem attachment 48 in the instance of the completion of a correct or proper swing.

As further shown in the succeeding illustrations of FIGS. 5-14 and 16, the front 26 and rear 22/24 stretch cords are designed in both length and modulus of stretch/elasticity in order to restrict the arc of the bat and the positioning of the hands during both the back swing and swing through motions. In particular, the upper rear elastic band (see in particular at 22 in each of FIGS. 9 and 11) provides correct hip rotation for the batter, with the lower rear elastic band 24 assisting in guiding foot drive and rotational motion. The forward 26 extending elastic band or cord 26 is further configured to provide, in combination, both hand speed and bat speed training (see as further shown in FIGS. 5, 6 and 10).

Figure 12:
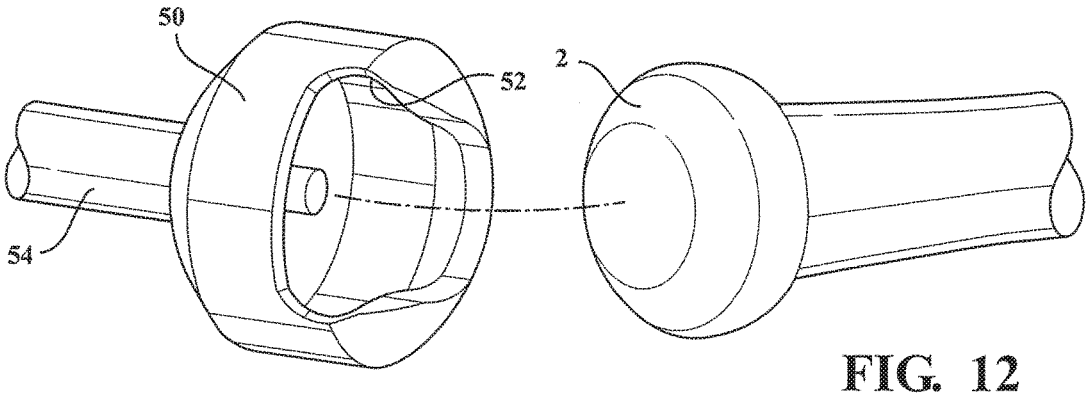
FIG. 12 is an exploded view of a bat knob end connecting attachment associated with a further embodiment of the invention.

As is further shown, the variants of the bat knob end attachments can also vary significantly and, in each instance, are intended to provide for releasable engagement to an existing bat. As shown in FIG. 12, an exploded view is shown of the bat knob end connecting attachment 44 previously identified in FIG. 13A and which can include a base mounting end 50, such as which exhibits a three dimensional lateral profile (see configured and closed perimeter defined wall edge 52 defining an open interior). The base mounting end exhibits an interior generally matching that of the baseball bat knob end 2 and, given the flexural nature of the plasticized material defining the base end 50, the knob end can be resistively fitted within the interior of the base mounting end (see FIG. 15) so that the attachment 44 is mounted in place with an end extending stem 54 configured similarly as that described in reference to alternate attachment 46.

It is further understood and envisioned that any other or additional suitable attachment or modification can be provided for establishing an extending stem end to the baseball bat, for receiving the rings 18/20, and such can also include drilling a linear recess into an end face of the knob for affixing thereto a rigid post. One such example is generally depicted at 56 in FIG. 17 and which can include a variation of that shown in FIGS. 13A and 15 in which a variation 58 of a base mounting end includes a smaller profile with a more linear and constant diameter recess channel 60 extending from a side to an interior center point of the base 58, this so that the base 58 is linearly slided over and against the inside of the knob end 2. A further engageable portion 62 of the base mounting end 58 can be snap engaged or otherwise affixed to a projecting annular edge of the base 58, so that a rear linearly extending stem 64 can similarly receive the ring attachments 18/20 in the manner previously described.

It is also envisioned that a suitable training bat could be produced as part of a kit or assembly and which may be initially molded or shaped (e.g. turned in the instance of a wooden bat) such that the knob end configuration with the extending stem may potentially be incorporated into the original bat design. The design of the harness in the illustrated embodiment is shown in use with a left handed batter, it being understood that the configuration of the harness and positioning of the three point connecting elastic bands can be reversed from that shown in order to accommodate a right handed batter.

According to the above description, the Ross Stretch/Catch Swing Trainer consists of a specially designed harness and bat handle butt attachment. As further described above and depicted in the attached illustrations, the user wears the swing harness that connects their bat by way of the bat handle butt attachment. Together, the swing harness and bat butt end attachment are used to correct flaws or errors in a baseball swing.

In general terms combined with the above description of the non-limited preferred embodiment, the harness attaches to the wearer's waist and back leg and to the bat, when the user is in the hitting position. As described, the rear pair of elastic cords or straps 22/24 that extend off the back side connect to the bat handle attachment. These straps are designed to adjust to the user size and starting swing position and are further designed in one non-limiting variant to stretch approximately four inches then catch or stop, allowing the user to load their hands the proper distance only in the pre-swing position, and then they will slide off the bat attachment upon swinging the bat, allowing the user to correctly complete their swing.

The harness also has the front stretch cord 26 which attaches to the harness at the users front hip while in the batting position. This stretch cord can be used alone or in conjunction with the back straps. The front speed strap is not restricted by the amount of stretch allowed on loading and its main purpose is to teach an inside swing and to promote quicker hands through assisted swing velocity. This stretch cord is attached to the specially designed bat handle butt attachment. As the user moves their hands back to load the speed cord is stretched. When the user starts their swing the speed cord pulls the users hand through the swing as it contracts. This assisting or pulling of the hands teaches or promotes the building of quicker twitch muscles, creating faster hands and a more powerful swing. As further understood, this speed cord 26 can be used alone or in conjunction with the back swing trainer straps 22/24.

The bat handle attachments 44, 46 or 56, in each instance, connects firmly to the bat handle butt, with a bar that extends the bat approximately six inches. The swing harness straps then slide onto this bar through the o-ring design, and off of the bar as the user swings the bat. This attachment also has a smaller tube or bar that extends out of the first bar.

The present invention further contemplates any type of stem shaped portion extending from the knob end of the bat. Consistent with and additional to the versions depicted in the illustrations, this can also include any elongated stem anchored in linearly extending fashion to the end surface of the knob, as well as a stem portion which is integrated into a cup shape or other shaped attachment for mechanically or resistively fitting to the cup shaped end of the butt handle of the bat (such as by conforming to the annular and perimeter contour of the butt end).

This smaller bar is metered and measures bat speed or whip. The faster the user swings the bat or the more whip applied, the more the inner tube will extend, which results in a more powerful baseball swing. The device extends when the batter properly swings the bat, through centrifugal force. Finally the bat butt attachment includes an adjustment band which allows the user to adjust the amount of force, bat speed, and whip needed to extend the inner measured tube. This feature allows the swing trainer to adjust to be used by anyone from beginning child to an adult professional baseball player.

Benefits of the training device are numerous and include:

- Giving immediate feedback the user both visual and feel.
- Provides a step-by-step process to the proper baseball swing.
- Light weight.
- Very Durable.
- Economical.
- User friendly.
- Can be used with most other hitting aide devices on the market.
- No partner needed.
- Will teach even the most novice user the proper swing.
- Convenient and compact to store.
- Incorporates both assisted and resistant training Increases power by lining up the three power points back hip, knee, and foot.

Teaches the hitter to be patient, letting the ball get deeper in the hitting zone.

Teaches a short to the ball and long through the hitting zone swing plane.

Focuses on both lower and upper half swing mechanics and proper balance.

Corrects most of the swing flaws seen from the novice to the professional hitter.

Flaws of the swing that are corrected by the Ross Stretch/Catch Swing Trainer further include, but are not necessarily limited, to each of the below described:

1. The batter not loading hands and wrists. The swing trainer gives both visual and feel feedback if the hand/wrists are properly loaded. Visually the user can look back and see that the stretch bands are fully extended to the catch position and feel the stretch resistance when the hands and wrists are loaded properly. Also the o-ring that slides onto the bat handle butt attachment will slide off if the hands and wrists are not loaded.

2. Not loading arm or loading arms to far back. The swing trainer gives both visual and feel feedback to the user if the arms are properly loaded. Visually the user will see the catch straps fully extended and feel the resistance from the stretch bands being extended. The user cannot extend their arms to far back creating a long swing path due to the catch design.

3. Load but then unloading hands and wrists early. The swing trainer will give both visual and feel feedback if the hands and wrists are unloaded. Visually the catch straps will sag and the o-ring will slide off the bat handle butt attachment and the user will no longer feel the resistance from the stretch bands.

4. Dropping the hand/arm prior to the swing (hitch). The swing trainer will give immediate visual and feel feedback. Visually the catch straps will sag and the user will not feel any resistance from the stretch cords. The o-ring may also slide off the bat handle butt attachment.

5. Swinging too far out away from your body (casting). The specially designed stretch/catch design will not allow the user to extend their hands too far out away from their body during the swing.

6. Not releasing the wrists at ball contact. The swing trainer stretch/catch design limits forward movement of the hands until the wrists are properly released creating the greatest amount of bat whip. The specially designed bat handle butt attachment will give immediate feedback to the user by the length of extension of the metered bar.

7. Not swinging long through the hitting zone. The bat handle butt attachment can be locked in the out position the correct distance from the butt to the user side with the front arm fully extended. This will teach the hitter to fully extend during the swing. The swing trainer straps are designed to release upon proper swing extension, promoting full extension.

8. Not getting the hips fully rotated through the swing. The stretch/catch design of the swing harness will force the hips to rotate equally with the hands. Once the stretch bands are extended the catch strap will lock and the hands can no longer extend unless the user rotates their hips. This creates equal hand and hip rotation, with the hands slightly in front for optimal bat speed and power.

9. Hitting the ball too far out front/not letting the ball travel. The swing harness design will give the user immediate feedback if they are hitting the ball too far out front by causing the wrists to rollover, hitting a top spin ground ball.

10. Hitter not rotating back foot/not getting on back toe. The bottom back strap on the swing harness is attached just above the back knee. When the user starts to swing the catch strap design will tighten forcing the hitter to rotate their back foot to complete the swing process.

11. Hands, hips, and back foot not aligned during swing. In order to create the maximum amount of bat speed all three the hands, hips, and back foot must be aligned. The Ross Stretch/Catch Swing Trainer is designed to tie all three the hands, hips, and back foot together by its duel back strap design. The batter cannot complete their swing without aligning all three.

12. Dragging the bat barrel through the hitting zone. The stretch/catch design of our swing trainer will not allow the hands to extend past the hitting zone without releasing the wrists because the o-ring will not slide off the bat handle butt attachment. So the hitter will be taught to release the wrists and not drag the bat through the hitting zone. The harness also has a vertical white line on the strap connecting the waist and leg straps. The user is taught to keep their hands in front or closer to the pitcher than the white line to prevent dragging the bat.

13. Falling back on the swing. The harness has a vertical white line that must finish directly between the feet and exactly vertical to prevent falling back. Visual feedback as the user can look down at the strap after each swing.

14. Lunging at the ball. The design of the swing training harness includes a vertical white line that must be directly between the users feet and exactly vertical upon finishing the swing. The user will get immediate feedback by looking at the strap white line after each swing.

Having described my invention, other and additional preferred embodiments will become apparent to those skilled in the art to which it pertains, and without deviating from the scope of the appended claims.

I claim:

1. A kit for instructing a batter swing, comprising:

a training harness including a belt adapted to being affixed about a wearer's waist;

a vertical portion extending downwardly from said belt and terminating in a looped portion adapted to being affixed about the wearer's upper leg;

a first pair elastic bands extending from vertically spaced locations of said belt and vertical portion;

a second individual elastic band extending from a further location of said belt;

each of said first pair of bands and said second individual band terminating in a ring;

an attachment for use with a bat, said attachment including a base mounting portion adapted to being affixed to a knob end of the bat, a stem extending from said base mounting portion along a centerline defined by a linear axis passing through a center of the longest axis of said bat; and said rings adapted to being slidably supported upon said stem;

said harness controlling a motion of the bat during each of a backswing and forward follow through to correct flaws in the batters swing, said rings detaching prematurely from said stem prior to completion of the swing to instruct incorrect positioning of the bat or said rings detaching from said stem during the forward follow through of a correct swing in order to allow the user to complete the swing.

2. The kit as described in claim 1, further comprising an upper band of said first pair of elastic bands teaching hip rotation during the swing, a lower of said first pair of elastic bands teaching foot drive and rotation during the swing.

3. The kit as described in claim 1, said second elastic band teaching each of hand speed and bat speed during the swing.

4. The kit as described in claim 1, further comprising a fixed buckle portion at a first end of said belt, an adjustable buckle portion at a second end of said belt.

5. The kit as described in claim 1, further comprising a pair of flexible and stretch limiting fabric portions associated with opposite connecting ends of said first pair of elastic bands and defining a maximum degree of stretch of said bands.

6. The kit as described in claim 1, said base mounting portion of said knob end attachment further comprising a closed perimeter profile accessing an open interior and for resistively seating therein the knob.

* * * * *